US009072391B1

(12) United States Patent
Jordan

(10) Patent No.: US 9,072,391 B1
(45) Date of Patent: Jul. 7, 2015

(54) PORTABLE MATERNITY MAT

(71) Applicant: Pevel Santos Jordan, Hyde Park, MA (US)

(72) Inventor: Pevel Santos Jordan, Hyde Park, MA (US)

( * ) Notice: Subject to any disclaimer, the term of this patent is extended or adjusted under 35 U.S.C. 154(b) by 0 days.

(21) Appl. No.: 14/462,751

(22) Filed: Aug. 19, 2014

(51) Int. Cl.

| | |
|---|---|
| ***A47C 27/14*** | (2006.01) |
| ***A47C 27/15*** | (2006.01) |
| ***A47C 27/00*** | (2006.01) |
| ***A47C 20/02*** | (2006.01) |

(52) U.S. Cl.
CPC ..... *A47C 27/146* (2013.01); *A47C 27/15* (2013.01); *A47C 27/001* (2013.01); *A47C 20/025* (2013.01)

(58) Field of Classification Search
CPC .... A47C 20/025; A47C 27/01; A47C 27/146; A47C 27/15
USPC ..... 5/630–632, 652, 657, 722, 735
See application file for complete search history.

(56) References Cited

U.S. PATENT DOCUMENTS

| | | | | |
|---|---|---|---|---|
| 1,002,006 | A * | 8/1911 | Stapely | 5/716 |
| 1,423,954 | A * | 7/1922 | Maussner | 5/722 |
| 3,378,862 | A * | 4/1968 | Skinner | 5/722 |
| 5,400,449 | A * | 3/1995 | Satto | 5/631 |
| 5,491,851 | A * | 2/1996 | Alonso | 5/722 |
| 6,581,229 | B2 * | 6/2003 | Bernstein | 5/722 |
| 8,365,327 | B2 * | 2/2013 | Jamshidi | 5/631 |
| 2009/0100601 | A1 * | 4/2009 | Battaglia | 5/631 |

FOREIGN PATENT DOCUMENTS

| | | | | |
|---|---|---|---|---|
| GB | 2439916 | A * | 1/2008 | A47C 27/14 |

* cited by examiner

*Primary Examiner* — Michael Trettel

(57) ABSTRACT

A portable maternity mat is provided. The portable maternity mat includes at least a first pad and a second pad. Each of the pads has an upper surface and a lower surface. Further, each pad includes a compressible material, such as mattress material. The first pad and the second pad are connected together by a hinged connector. The first pad, the second pad, or a combination of the pads may include a cutout portion through the upper surface. Therefore, a pregnant woman may use the portable maternity mat to lay on their stomach, and may fold the portable maternity mat to move and store the portable maternity mat.

14 Claims, 2 Drawing Sheets

PORTABLE MATERNITY MAT

BACKGROUND OF THE INVENTION

The present invention relates to mattresses and, more particularly, to a portable maternity mat.

Conventional mattresses are flat cushioned supports which can cause or aggravate orthopaedic problems. They may be particularly uncomfortable for pregnant women, due to the increasing shape, size and weight of the woman's abdomen as pregnancy proceeds. Lying on the back may be the only option available to the woman for the second half of the term of pregnancy, but many people can find it difficult to sleep on their backs. Very often the only position which might provide any degree of comfort, namely sleeping on the front, is denied due to the discomfort and to the fear of injuring the developing fetus.

As can be seen, there is a need for a mat that allows a pregnant woman to sleep on their stomach.

SUMMARY OF THE INVENTION

In one aspect of the present invention, a portable maternity mat comprises: at least a first pad and a second pad each comprising an upper surface and a lower surface, wherein each of the first pad and second pad comprise compressible material, wherein the first pad and the second pad are connected together by a hinged connector, wherein at least one of the first pad and the second pad comprise a cutout portion through the upper surface.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
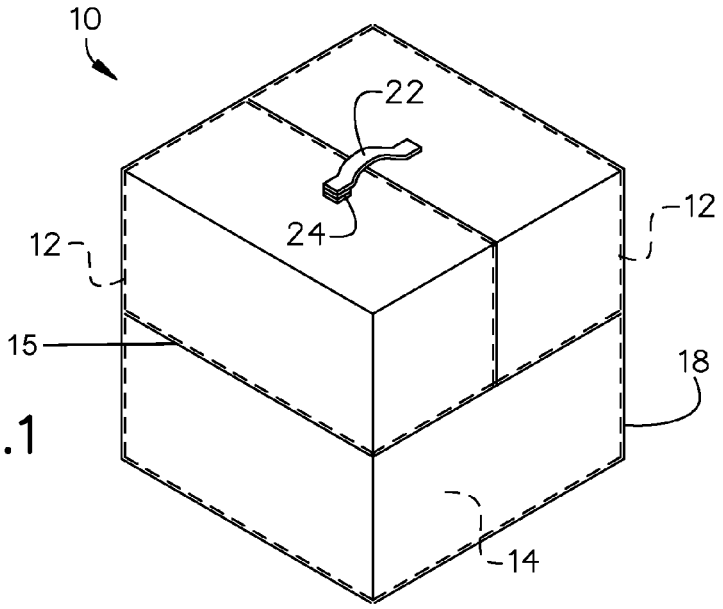
FIG. 1 is a perspective view of the present invention shown in retracted configuration.
Figure 2:
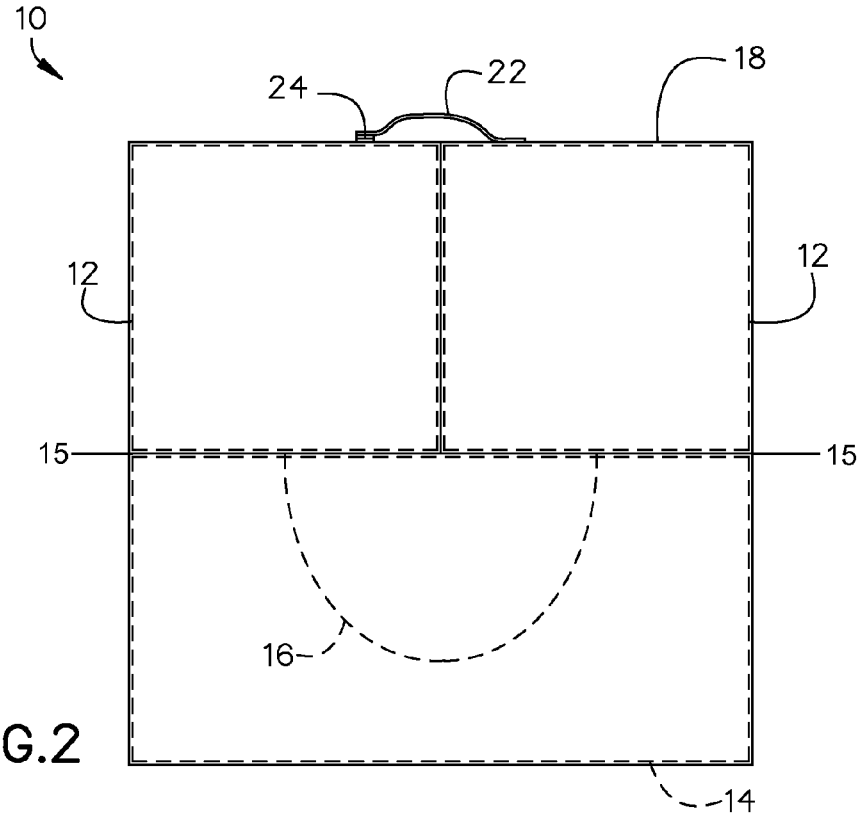
FIG. 2 is a side view of the present invention shown in retracted configuration.
Figure 3:
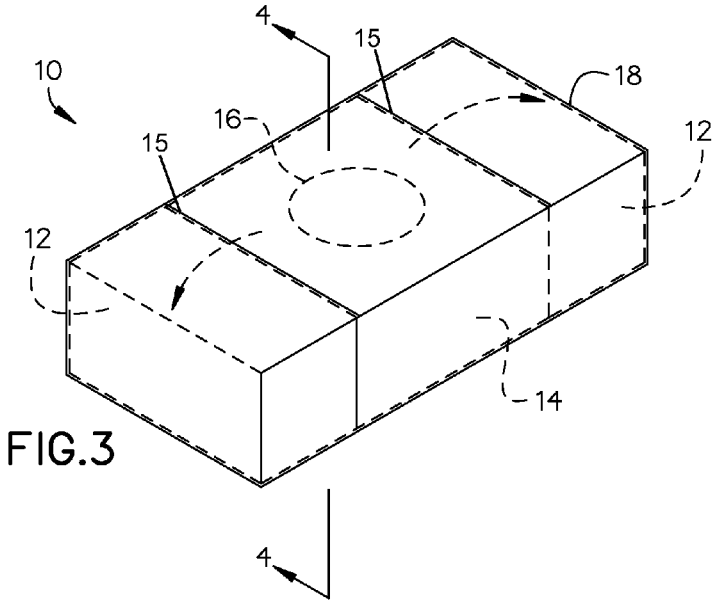
FIG. 3 is a perspective view of the present invention shown in expanded configuration.
Figure 4:
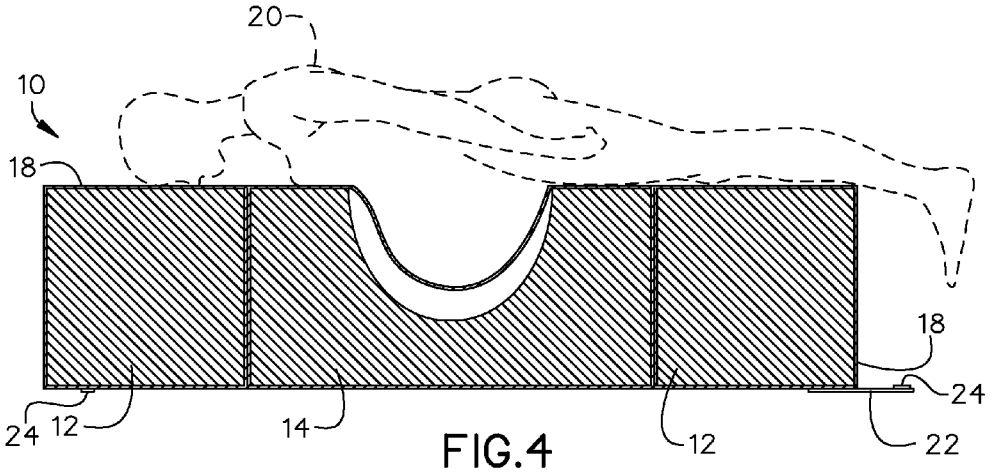
FIG. 4 is a section view of the present invention shown in use along line 4-4 in FIG. 3.

Referring to FIGS. 1 through 4, the present invention includes a portable maternity mat 10. The portable maternity mat includes at least a first pad 12 and a second pad 14. Each of the pads 12, 14 has an upper surface and a lower surface. Further, each pad 12, 14 includes a compressible material, such as mattress material. The first pad 12 and the second pad 14 are connected together by a hinged connector 15. The first pad 12, the second pad 14, or a combination of the pads 12, 14 may include a cutout portion through the upper surface. Therefore, a pregnant woman 20 may use the portable maternity mat 10 to lay on their stomach, and may fold the portable maternity mat 10 to move and store the portable maternity mat 10.

In certain embodiments, the present invention includes an expanded form and a retracted form. The portable maternity mat 10 converts between the expanded form and the retracted form by the first pad 12 and/or the second pad 14 rotating about the hinged connector 15. The expanded form includes the upper surfaces of the first pad 12 and the second pad 14 being substantially planar to one another, and therefore forming the laid out mat for a user to lie on. The retracted form includes the upper surfaces of the first pad 12 and second pad 14 facing one another. The retracted form, the pad 10 is folded together and may be easily transported.

The cutout portion 16 of the present invention may be circular to receive the abdomen of a pregnant woman 20. The present invention may include a covering 18 over at least the cutout portion 16 to support the abdomen of the pregnant woman 20. The covering 18 may be a stretchable material. The covering may cover each of the pads 12, 14 and may form a seam in between the first pad 12 and the second pad 14. The seam may act as the hinged connector 15, and the pads 12, 14 may rotate relative to one another about the seam. The stretchable material may be elastane or any other stretchable fabric.

The compressible material of the pads 12, 14 may be made out of any mattress material. The compressible material may include an inner spring mattress material, water, cotton, air, memory foam or a combination thereof. However, the compressible material is not limited to the above list, and may include any compressible material known in the art.

In certain embodiments, the present invention may include a third pad 12, with an upper surface and a lower surface, as well as the compressible material. In such embodiments, the second pad 14 may include a front end and a rear end. The first pad 12 is connected to the front end by a first hinged connector 15 and the third pad 12 is connected to the rear end by a second hinged connector 15. The second pad 14 may thereby be in between the first and third pads 12 and may therefore include the cutout portion 16.

In such embodiments, the first pad 12 and the third pad 12 may each be half the size of the second pad 14. Therefore, the first pad 12 and the third pad 12 may rotate about the hinged connector 15 and both rest on top of the second pad 14 in the retracted form. The expanded form includes the upper surface of the first pad 12, the second pad 14, and the third pad 12 being substantially planar to one another. Further, the retracted form includes the upper surface of the first pad 12 and the third pad 12 facing the upper surface of the second pad 14.

The first pad 12 and the third pad 12 may be adjacent to one another in the retracted position. Further, the lower surface of the first and third pad 12 may be substantially planar in the retracted position. In certain embodiments, the third pad 12 may include a handle 22 attached to the lower surface. The first pad 12 may include a connector 24 attached to the lower surface connectable to the handle 22. Therefore, when the portable maternity mat 10 is in the retracted position, the handle 22 may releasably attach to the connector 24 and a user may transport the present invention via the handle 22. In certain embodiments, the connector 24 may include a hook and loop fastener on the handle 22 and the lower surface of the first pad 12.

In certain embodiments, the second pad may be about 18 inches deep, about 24 inches wide and about 36 inches long. The first and third pad may each be about 18 inches deep, about 24 inches wide and about 18 inches long. Therefore, the entire mat 10 may be about 72 inches in length, about 18 inches deep and about 24 inches in width. The cutout portion 16 may be about 12 inches deep. However, the present invention is not limited to the above dimensions and may be any suitable dimensions to perform the desired function.

It should be understood, of course, that the foregoing relates to exemplary embodiments of the invention and that modifications may be made without departing from the spirit and scope of the invention as set forth in the following claims.

What is claimed is:

1. A portable maternity mat comprising:

at least a first pad, a second pad, and a third pad each comprising an upper surface and a lower surface, wherein each of the first pad, the second pad, and the third pad comprise compressible material, wherein the second pad comprises a front end and a rear end, wherein the first pad is connected to the front end by a first hinged connector and the third pad is connect to the rear end by a second hinged connector wherein the second pad comprises a cut out portion through the upper surface, wherein the lower surface of the third pad comprises a handle portion and the lower surface of the first pad comprises a connector, wherein the handle portion is releasably connectable to the connector.

2. The portable maternity mat of claim 1, further comprising an expanded form and a retracted form, wherein the portable maternity mat converts between the expanded form and the retracted form by at least one of the first pad, the second pad, and the third bad rotating about at least one of the first and second hinged connectors.

3. The portable maternity mat of claim 2, wherein the expanded form comprises the upper surfaces being substantially planar to one another, wherein the retracted form comprises the upper surfaces of the first pad and the third pad facing the second pad.

4. The portable maternity mat of claim 1, wherein the cutout portion is covered with a stretchable material.

5. The portable maternity mat of claim 4, wherein the stretchable material covers each of the first pad, the second pad, and the third pad forming a seam in between the first pad, the second pad, and the third pad, wherein the seams are the first and second hinged connectors.

6. The portable maternity mat of claim 4, wherein the stretchable material is elastane.

7. The portable maternity mat of claim 1, wherein the compressible material is a memory foam.

8. A portable maternity mat comprising:

at least a first pad and a second pad each comprising an upper surface and a lower surface, wherein each of the first pad and second pad comprise compressible material and wherein at least one of the first pad and the second pad comprises a cutout portion through the upper surface; and a stretchable material covering each of the first pad and the second pad and thereby covering the cutout portion, wherein a seam is in between the first pad and the second pad forming a hinged connector.

9. The portable maternity mat of claim 8, further comprising an expanded form and a retracted form, wherein the portable maternity mat converts between the expanded form and the retracted form by at least one of the first pad and the second pad rotating about the hinged connector.

10. The portable maternity mat of claim 9, wherein the expanded form comprises the upper surfaces of the first pad and the second pad being substantially planar to one another, wherein the retracted form comprises the upper surfaces of the first pad and second pad facing one another.

11. The portable maternity mat of claim 8, further comprising a third pad comprising an upper surface and a lower surface, wherein the third pad comprises compressible material, wherein the second pad comprises a front end and a rear end, wherein the first pad is connected to the front end by a first hinged connector and the third pad is connect to the rear end by a second hinged connector.

12. The portable maternity mat of claim 11, wherein the second pad comprises the cut out portion through the upper surface.

13. The portable maternity mat of claim 8, wherein the stretchable material is elastane.

14. The portable maternity mat of claim 8, wherein the compressible material is a memory foam.

* * * * *